US006113340A

United States Patent [19]

Zalal

[11] Patent Number: 6,113,340

[45] Date of Patent: Sep. 5, 2000

[54] AUTOMATIC DEBRIS REMOVAL SYSTEM

[76] Inventor: Abdul Ghafar Zalal, 2800 Fairview, Raleigh, N.C. 27608

[21] Appl. No.: 09/075,769

[22] Filed: May 11, 1998

Related U.S. Application Data

[60] Provisional application No. 60/077,016, Mar. 6, 1998.

[51] Int. Cl.[7] ..... B06F 11/00

[52] U.S. Cl. ..... 414/598; 414/645; 414/814

[58] Field of Search ..... 414/10, 595, 598, 414/602, 610, 617, 639, 645, 646, 648, 649, 652, 656, 814; 187/241

[56] References Cited

U.S. PATENT DOCUMENTS

| | | | |
|---|---|---|---|
| 2,011,656 | 8/1935 | Sill | 414/645 |
| 2,034,147 | 3/1936 | Martelock | 414/645 |
| 2,055,902 | 9/1936 | Levinstim | 414/645 |
| 2,297,572 | 9/1942 | Martin | 414/595 |
| 2,588,458 | 3/1952 | Allphin et al. | 414/595 |
| 2,655,276 | 10/1953 | Brodeske | 414/598 |
| 2,941,681 | 6/1960 | Reyes | 414/602 X |
| 3,653,526 | 4/1972 | Kennedy, Jr. | 414/645 X |

*Primary Examiner*—James W. Keenan
*Attorney, Agent, or Firm*—Mills Law Firm PLLC

[57] ABSTRACT

An automatic debris removal system for use in combination with a pre-existing construction hoist of the type including a plurality of telescoping extension members. Such a hoist includes a carriage device which traverses the extended hoist by means of a cable/winch mechanism that is an integral component of the hoist. The present debris removal system includes a tilting dumpster or bucket which is mechanically coupled to the carriage device and is transportable from ground level to the roof under construction for carrying debris and other materials. The present system includes a detachable chute device which is attached at the base of hoist to receive debris from the dumpster which is conducted by gravity to a dump truck for disposal. The present system also includes an automatic release mechanism for dumping the contents of the bucket as it contacts the chute at the lowermost position of its travel.

9 Claims, 5 Drawing Sheets

AUTOMATIC DEBRIS REMOVAL SYSTEM

CROSS-REFERENCE TO RELATED APPLICATION

This Application claims the benefit under 35 U.S.C. 119(e) of United States Provisional Application No. 60/077,016 filed Mar. 6, 1998, by Abdul Ghafar Zalal for Automatic Debris Removal System.

BACKGROUND OF INVENTION

FIELD OF INVENTION

The present invention relates to debris removal apparatus and, more particularly, to an automatic debris removal system for roofing construction.

In the roofing trades, it is often necessary to completely remove an existing roof structure prior to replacement with a new roof. This procedure involves the tear off and removal of the roof materials such as asphalt coatings, shingles, roofing paper, asbestos, plywood and other materials, which must be delivered to a dump truck at ground level for disposal.

In the conventional practice, this procedure was accomplished by use of a crane to hoist a dumpster to the top of the building and to subsequently remove the dumpster when filled. In the alternative various chute systems have been devised to remove debris from the roof surface and deliver it to a dump truck.

However, such conventional systems have inherent drawbacks and are difficult to manage for multiple story buildings. Thus, the present automatic debris removal system has been developed for use in combination with a telescoping hoist device to provide automatic loading and dumping of roofing debris.

SUMMARY OF THE INVENTION

The debris removal system of the present invention is designed for use in combination with a telescoping hoist or elevator device of the type used in the roofing construction trades. Such a construction elevator includes a plurality of telescoping extension members which are designed in the manner of an extension ladder. The construction elevator is easily transported to the job site on a trailer and is utilized to carry roofing materials from the ground level to the roof surface by means of a carriage device driven by a winch/cable mechanism which traverses the elevator.

The present automatic debris removal system includes a so-called tilting bucket which is mechanically coupled to the carriage device which travels up and down the elevator permitting roofing debris to be carried from the roof surface to ground level for release onto a chute that empties by gravity into a dump truck for disposal. The tilting bucket is pivotally mounted on a mechanical linkage assembly which is actuated when the bucket reaches its lowermost position of travel thereby releasing the load of debris. Thereafter, the dumping bucket is reset manually into its loading position and is returned to the roof surface for another load of debris.

In this manner, the present system can be utilized efficiently to remove roofing debris from any roof surface which can be reached by the telescoping elevator providing reduced labor costs for the removal of debris and also the transport of new replacement materials to the roof.

From the above it can be seen that the present invention provides an automatic debris removal system for use in combination with a pre-existing telescoping hoist at a building construction site.

The automatic debris removal system includes a so-called tilting bucket which is pivotally mounted to a carriage device that traverses the telescoping hoist by means of a winch/cable mechanism carrying roofing debris from the building roof to ground level for disposal.

Another object of the present invention is to provide the tilting bucket component with an automatic dumping mechanism which is actuated as the bucket reaches its lowermost point of travel on the hoist thereby unloading debris for removal.

Another object of the present invention is to provide a detachable chute which is mounted onto the hoist device to receive debris being unloaded from the tilting bucket and to conduct such debris by gravity into a waiting dump truck.

Another object of the present invention is to provide an automatic debris removal system which will reduce labor costs associated with the disposal of such roofing debris.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
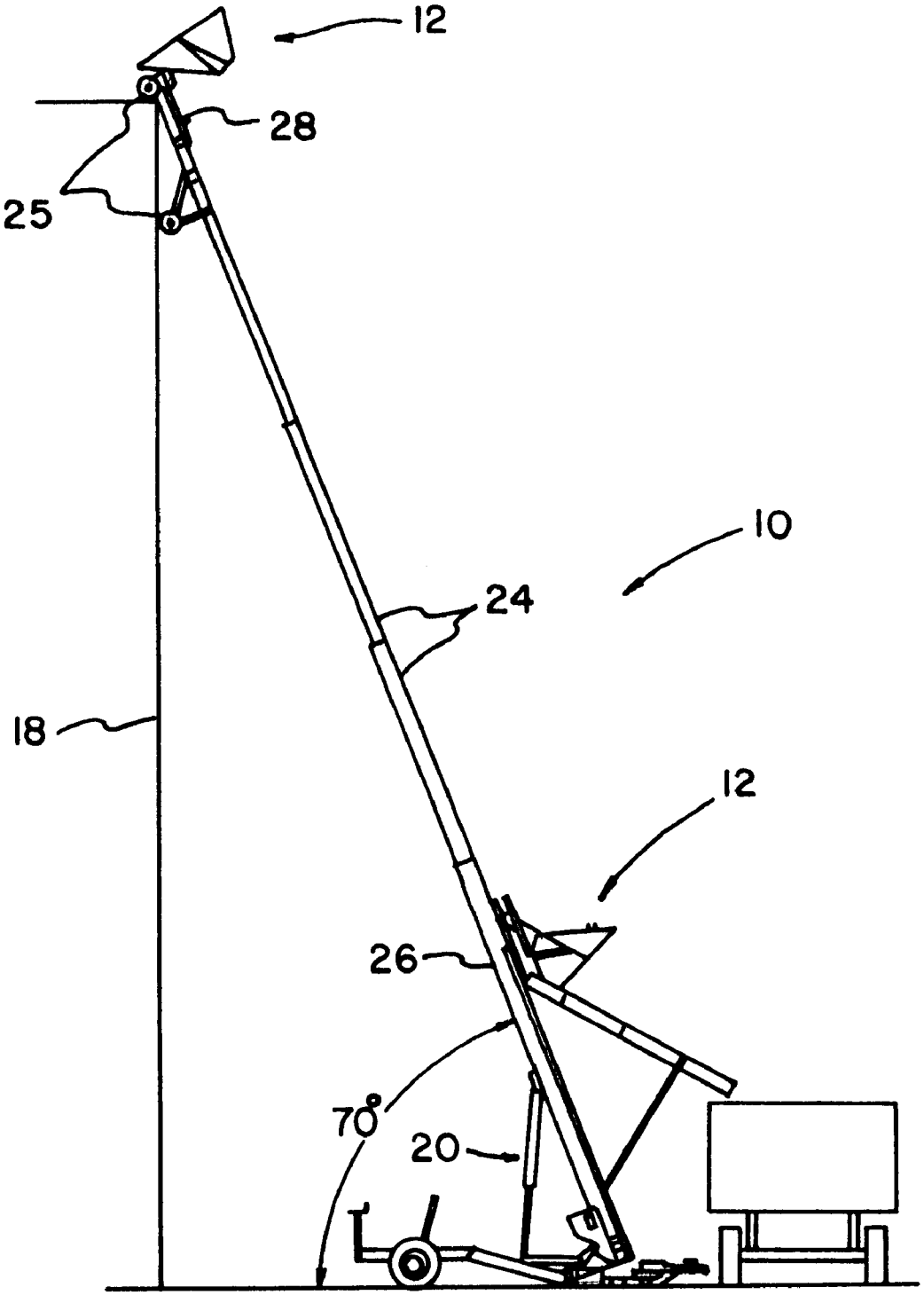
FIG. 1 is a composite elevational view of the automatic debris removal system of the present invention in operation and installed on a telescoping construction hoist showing its range of travel.

With reference to the drawings, there is shown therein an automatic debris removal system in accordance with the present invention, indicated generally at 10 and illustrated in FIG. 1. The automatic debris removal system 10 is shown installed on a telescoping hoist device, indicated generally at 20. It will be understood that the present system includes only a single tilting bucket 12 and illustrated in an upper position at the top of the hoist 20 in solid lines and at a lower position in dashed lines shown for purposes of illustrating the range of travel as described hereinafter in further detail.

The hoist device 20 is of the type being mounted on a trailer 22 and includes a plurality of extension members 24 adapted for telescoping extension from a main frame 26. The hoist 20 includes a mechanical winch system (not shown) together with operating controls (not shown) which permit a variety of construction materials to be transported upwardly from ground level on a carriage 28 which travels the length of the hoist 20 to the roof of the building 18.

A telescoping hoist of the type manufactured by AlberB öcker Lo GMbH is suitable for this purpose and for use in combination with the debris removal system of the present invention.

Since such telescoping hoists are well known to those skilled in the art, further detailed discussion of the same is not deemed necessary.

Figure 3:
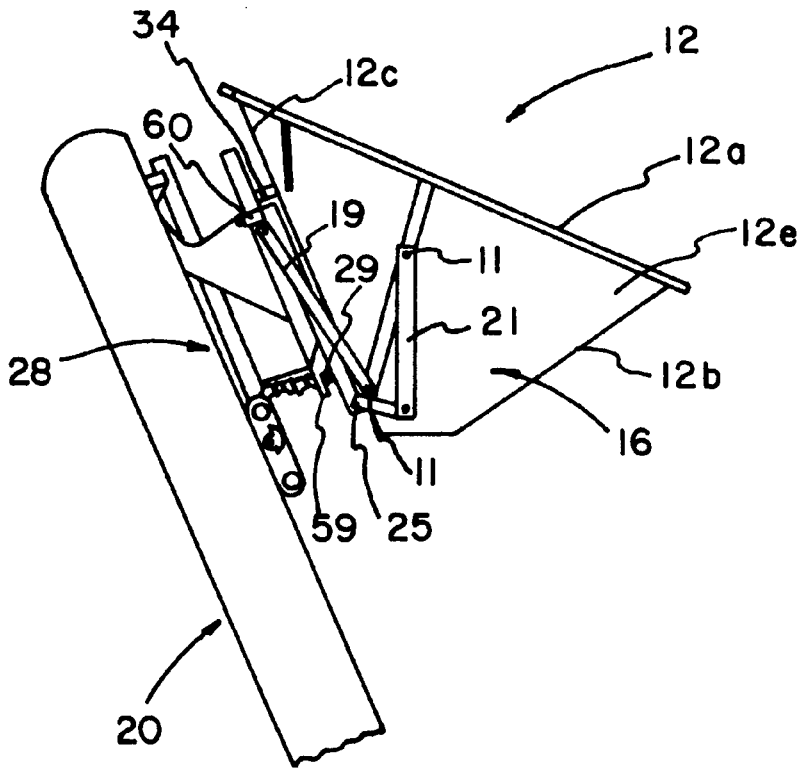
FIG. 3 is an enlarged elevational view of the tilting bucket mounted on a carriage device and installed on the telescoping hoist.

The automatic debris removal system 10 includes a tilting bucket, indicated generally at 12 which is mechanically coupled to the carriage 28 by suitable attaching hardware as shown in FIG. 3. Thus, the carriage 28 and the attached bucket 12 travel up and down the hoist 20 in operation carrying debris from the roof to the chute, indicated generally at 14, where the load of debris is automatically released sliding by gravity into a dump truck, indicated generally at 30.

In the preferred embodiment the tilting bucket is tetragonal in crosssection having an open top 12*a*, a front wall 12*b*, a back wall 12*c*, a bottom wall 12*d*, and a pair of generally parallel side walls 12*e*. Thus, the bucket 12 is configured as an open trough structure wherein roofing debris or other materials may be loaded for transport from the rooftop to ground level and vice versa. In the preferred embodiment, the tilting bucket 12 is fabricated from sheet steel and joined at the corner junctures thereof by weldment.

Figure 2:
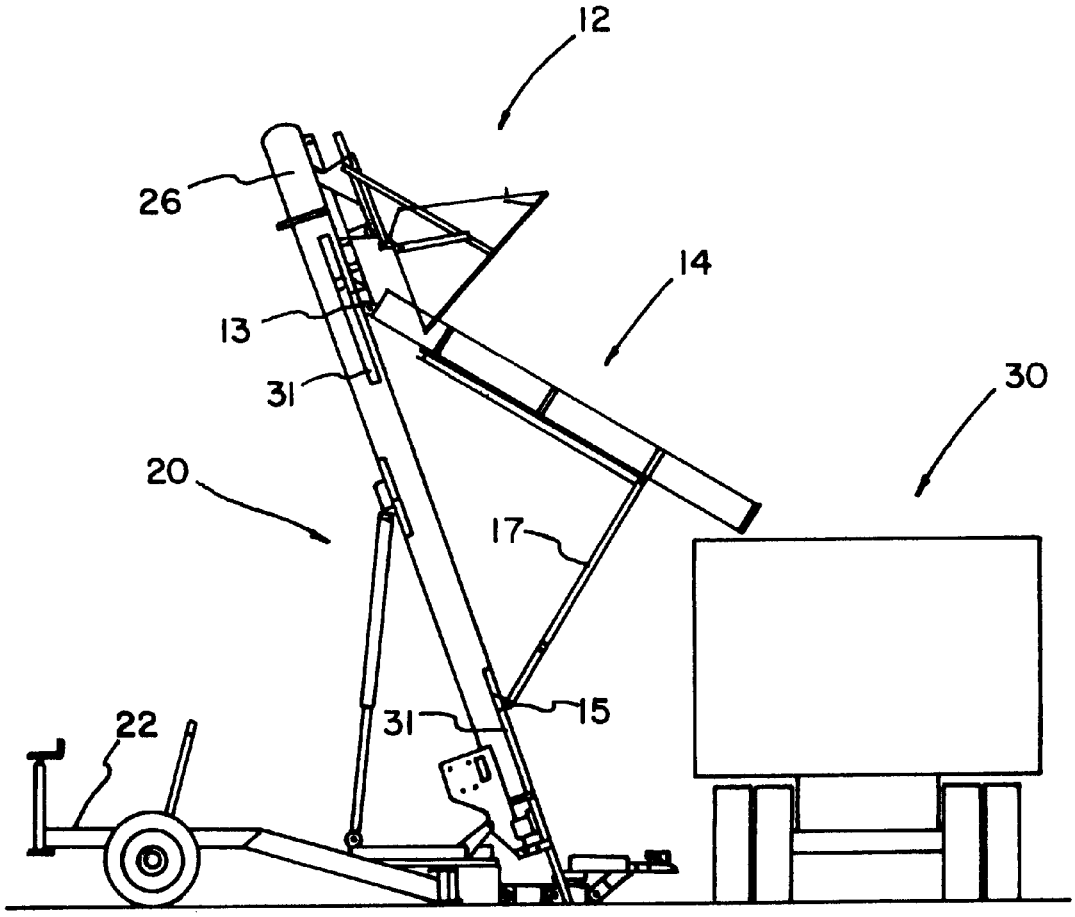
FIG. 2 is an enlarged elevational view of the automatic debris removal system showing the tilting bucket at its lowermost position of travel in functional relation to the debris chute.
Figure 6:
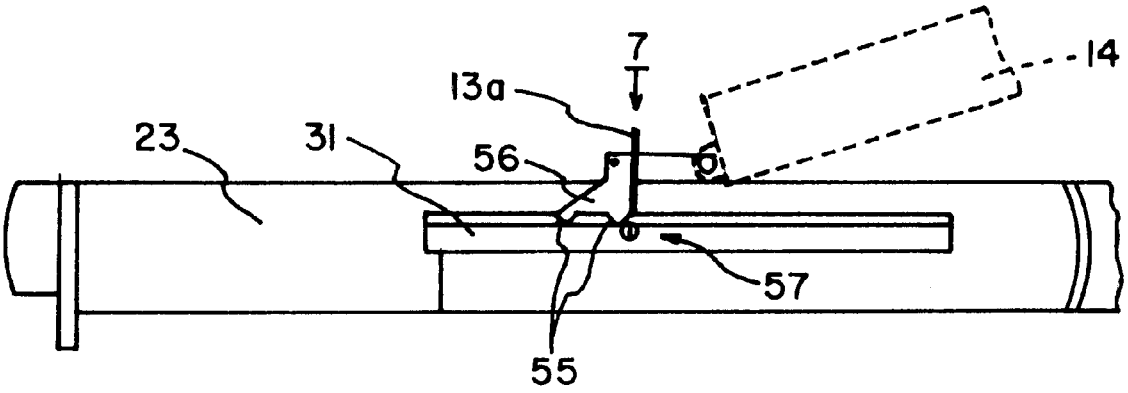
FIG. 6 is an elevational view of the guide rail for attachment of the debris chute to the hoist.

It will be appreciated by those skilled in the art that the tilting bucket 12 is an asymmetrical construction as shown in FIG. 3 and that a load of debris carried therein will be distributed in an out-of-balance of condition such that when the release mechanism thereof is actuated the bucket 12 will rotate downwardly by gravity dumping the contents thereof into the chute 14 as explained hereinafter in further detail. The chute 14 as shown in FIG. 6 is pivotally attached at its upper end to the tie bar 13 on the hoist at pin connection 13*b*. As shown in FIG. 2, the chute 14 is supported in an inclined position relative to the hoist by a support member 17 attached at a lower end to transverse tie bar 15 and at an upper end to the underside of the chute 14.

The tilting bucket 12 is pivotally mounted on a pair of linkage arm assemblies, indicated generally at 16 as shown in FIG. 3. Each linkage arm assembly 16 includes a retaining bracket 19 and an extension bracket 21 which are pivotally attached at one end thereof to pivot pins 11 which project outwardly from the side walls 12*e* of the bucket. The opposite ends of the retaining bracket 19 and the extension bracket 21 are pivotally attached to a linkage arm support frame 25 which extends between and interconnects the opposed linkage arm assemblies 16 on both ends of the bucket 12. The linkage arm support frame 25 is attached to the carriage 28 as described hereinafter in further detail.

Figure 5:
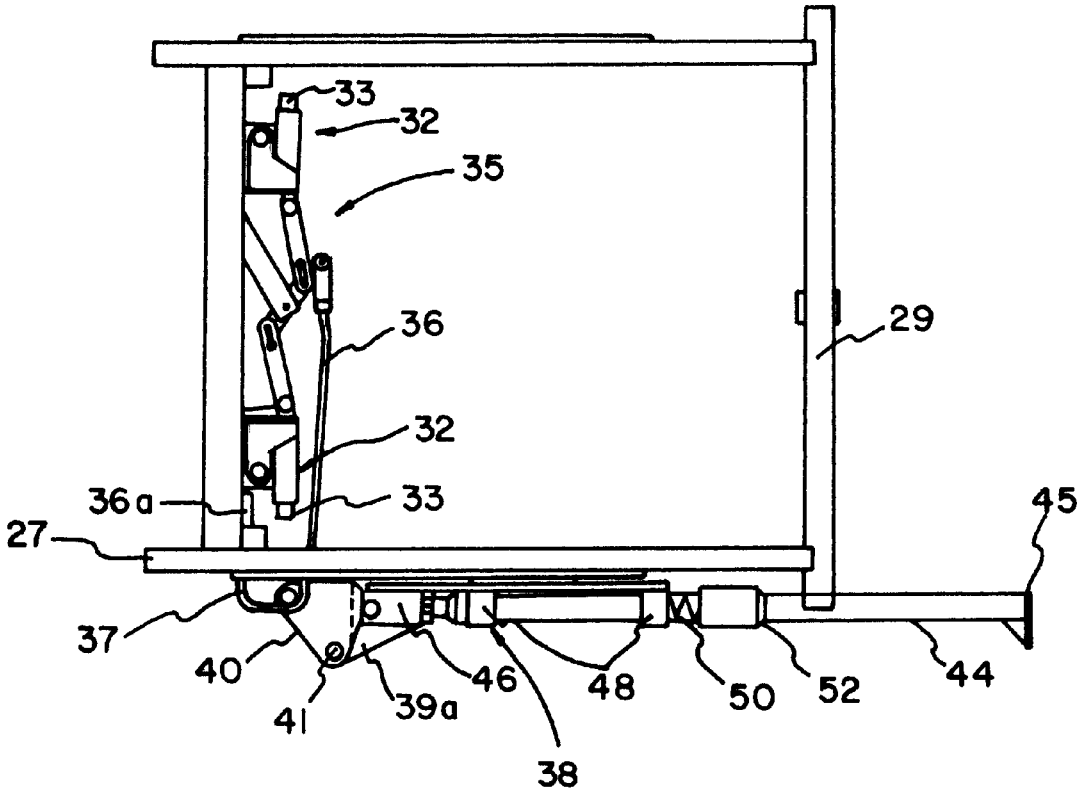
FIG. 5 is a plan view of the carriage device showing further details of the bucket release mechanism.

In this arrangement, the bucket 12 is adapted for pivoting movement from a dumping position as shown in FIG. 2 to a loading position as shown in FIG. 3. The tilting bucket 12 is secured in the loading position shown in FIG. 3 by use of a pair of latches, indicated generally at 32 as shown in FIG. 5 which engage a pair of mating catches or hooks 34 integrally formed on the outside of back wall 12*c* of the bucket 12 as shown in FIG. 3. Latches 32 include retractable plungers 33 which are actuated by a mechanical latch linkage, indicated generally at 35 as shown in FIG. 5.

The latch linkage 35 is operatively connected to an elongated control rod 36 which extends laterally and loosely penetrates an aperture (not shown) in the carriage frame member 27 terminating in a J-shaped hook portion 36*a*. The terminal end of the J-shaped hook 36*a* re-enters the carriage frame member 27 from the outside through a second aperture (not shown) forming a loop or handle 37.

The loop 37 is operatively connected to a knee-joint mechanism, indicated generally at 38, which draws the control rod 36 laterally to release the latches 32 as hereinafter described. The knee-joint mechanism 38 includes a mounting bracket 39 having a right angle shelf portion 39*a* whereon a cam 40 is pivotally mounted by a pivot pin 41. An upwardly projecting finger member 42 is attached to the cam plate 40 to engage the loop 37 as more clearly shown in FIG. 4.

Referring again to FIG. 5, the cam plate 40 is disposed in operating engagement with an elongated actuating rod 44 which terminates in a foot member 45. An opposite end of the rod 44 is provided with a driver head 46 which engages the cam plate 40 in operation.

The rod 44 loosely penetrates and is supported by a pair of outwardly projecting guide brackets 48 which are fixedly attached to the mounting bracket 39. A compression spring 50 is disposed between the bracket 48 and a stop collar 52 to return the rod 44 to the proper position after actuation of the release mechanism as hereinafter described.

To install the present system the chute 14 is disposed on the hoist at a predetermined angle and mechanically coupled thereto by the use of an upper tie bar 13 and a lower tie bar 15 located as shown in FIG. 2.

As more clearly shown in FIG. 6 the upper tie bar 13 comprises an elongated generally rectangular steel bar which extends transversely across the hoist 20 being mechanically coupled to the outer rail members 23 thereof by suitable attaching hardware.

Figure 7:
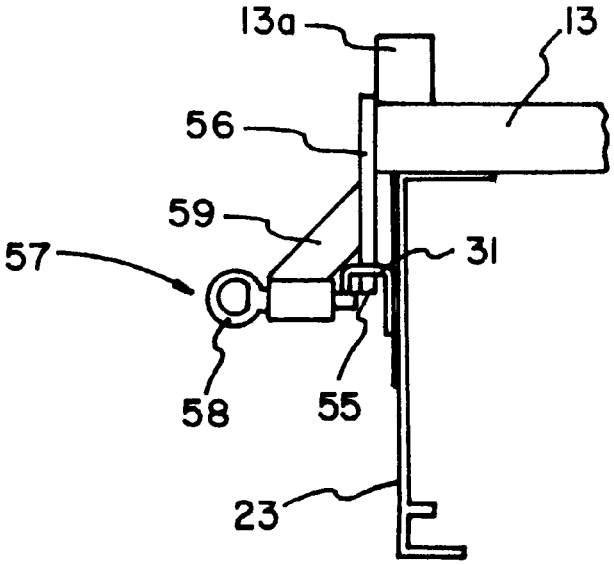
FIG. 7 is a cross-sectional view taken through the plane indicated in FIG. 6.

In the preferred embodiment an inverted J-shaped guide rail 31 is attached to an outer surface of each outer rail 23 as shown in FIG. 6. An upwardly facing surface of the guide rail 31 includes a plurality of slots (not shown) formed therein at regular intervals which engage a plurality of mating tabs 55 formed on the tie bar shoes 56 as more clearly shown in FIG. 7.

Shoe 56 includes a spring loaded catch, indicated generally at 57, being attached thereto. Catch 57 includes a spring loaded key 58 which extends inwardly through the catch body 59 to engage the guide rail 31 thereby preventing the tabs 55 from becoming disengaged from the rails 31 and allowing the chute 14 to be moved inadvertently.

Figure 4:
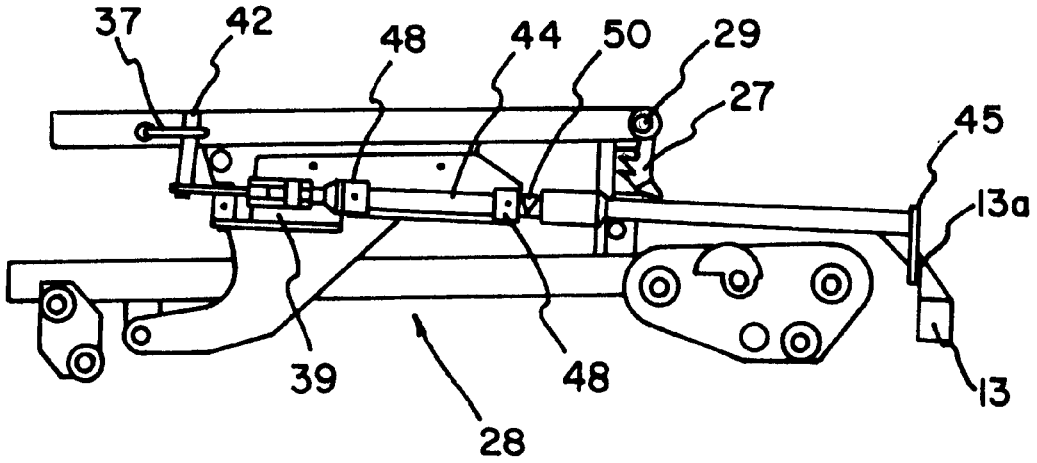
FIG. 4 is an enlarged elevational view of the carriage device of FIG. 3 showing details of the bucket release mechanism.

The upper tie bar 13 includes an upwardly projecting stop plate 13*a* shown in FIG. 4 which comes into direct contact with the foot member 45 to actuate the automatic release and dumping of the tilting bucket 12 during use.

It will be understood that the lower tie bar 15 is constructed substantially similar to the upper tie bar 13 being attached to the hoist by a second pair of guide rails 31 as most clearly shown in FIG. 2.

In order to install the tilting bucket 12 onto the carriage 28, the linkage arm assemblies 16 are attached to the carrying tube 29 of the carriage 28 using suitable attaching hardware. In the preferred embodiment, the linkage arm assembly 16 includes a pair of generally U-shaped forks 59 which engage the carrying tube 29 as most clearly shown in FIG. 3. The forks 59 are fixedly attached to a transverse brace member of the linkage arm support frame 25 which extends between and interconnects the opposed pair of linkage arm assemblies 16 at either end of the bucket 12. The forks 59 loosely engage the carrying tube 29 to permit the tilting movement of the bucket 12 in operation. The linkage arm support frame 25 is also secured to carriage frame member 27 by suitable attaching hardware as at 60.

After the tilting bucket 12 and chute 14 have been installed in the desired position, it may be necessary to adjust the angular orientation of the actuating rod 44 relative to the stop plate 13*a* to properly actuate the release mechanism of the bucket 12. This may be accomplished by loosening the mounting bracket 39 secured to the outer rails 23 and shifting its position to align the rod 44 to a desired position.

In operation the hoist 20 is moved into the position shown in FIG. 1 with sufficient extension members 24 deployed to position the guide wheels 25 in the location shown in FIG. 1.

Next, the tilting bucket 12 is elevated to the roof level of the building by use of the carriage 28 and the winch mechanism (not shown) of the hoist 20. After the bucket 12 is filled with roof debris, it is lowered by the control operator to the position shown in FIG. 2.

As the tilting bucket 12 approaches the chute 14 and the foot 45 comes into contact with the stop plate 13*a* of the upper tie bar 13 as seen in FIG. 4, the actuating rod 44 is driven upwardly and rotates the knee joint 38 which draws the control rod 36 laterally retracting both latches 32 thereby releasing the bucket 12 which rotates downwardly by gravity dumping the debris contained therein into the chute 14 and into the dump truck 30.

Thereafter, the bucket 12 is manually reset to the loading position and returned to roof level by use of the winch system to the position shown in FIG. 1 for refilling.

From the above it can be seen that the automatic debris removal system provides an efficient and cost effective method for removal of roof construction material to ground level for disposal.

The apparatus of the present invention is utilized in combination with a pre-existing hoist of the type having a power winch mechanism which is known in the roofing construction trade.

The apparatus is adaptable for use on buildings up to 180 feet in height and is adjustable to accommodate various roof configurations.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An automatic debris removal system in combination with a construction hoist of the type having a plurality of telescoping members for inclination against an elevated portion of a building, said hoist including a winch operated cable system for transporting a carriage device from ground level at a first position to said elevated portion at a second position, said system comprising:

a tilting bucket means pivotally connected to said carriage device for rotation from a loading position to an unloading position;

debris receiving means including an elongated chute for receiving debris from said bucket means, said chute being attached to and inclined with respect to said telescoping members of said hoist by an upper tie bar disposed transversely on the telescoping members at said first position and preventing downward movement of the carriage device therebelow; and automatic releasing means attachable to said carriage device including actuating means, said releasing means being actuated upon movement of said carriage device from said second position to said first position by direct contact of said actuating means with said tie bar enabling said bucket means to be automatically released from said loading position to said unloading position to dispose of debris contained therein.

2. The debris removal system of claim 1 wherein said actuating means includes a knee-joint mechanism having an actuating rod being fixedly attached to said carriage device, said actuating rod contacting a stop device integrally formed on said upper tie bar and positioned at the lowermost point of travel of said bucket means to actuate said releasing means.

3. The debris removal system of claim 2 wherein said knee-joint mechanism is mechanically coupled to a plurality of latches engaging said bucket means such that actuation of said knee-joint mechanism withdraws said latches to release said bucket means to said unloading position.

4. A method of removing roofing construction debris to ground level for disposal, said method comprising the steps of:

providing a telescoping construction hoist of the type having a plurality of elongated extension members being traversed by a carriage device and controlled by a cable/winch system;

positioning said hoist at a predetermined angle relative to said building;

supplying a tilting bucket means including a linkage arm assembly being pivotally attached to said bucket means;

mounting said tilting bucket means on said carriage in operative relation thereto;

installing an automatic release mechanism on said carriage in functional relation to said bucket means;

attaching a debris removal chute to said hoist capable of receiving said roofing debris;

positioning said chute on said hoist at a predetermined location in adjustable relation thereto;

transporting said bucket means on said hoist to said roof by operation of said cable/winch system;

filling said bucket means with roofing debris to be disposed of; and lowering said bucket means with said cable/winch system to a predetermined location on said hoist such that said automatic release mechanism comes into direct contact with a stop device on said chute thereby automatically dumping said debris into said chute for disposal.

5. In a construction hoist of the type having a plurality of telescoping members, a winch operated cable system for transporting a carriage along said telescoping members from a lower position adjacent ground level to an upper position on a building for removing construction materials from said upper position to said lower position for delivery into a container member in a tilting bucket pivotally attached to said carriage and pivotally movable between a loading position and an unloading position, an automatic debris removal device, comprising:

an elongated chute for receiving debris from said bucket at said unloading position, said chute having an upper end pivotally attached at said lower position to said telescoping members at a first transverse member limiting downward movement of the carriage;

locking means cooperating between said carriage and said bucket for maintaining said bucket in said loading position in a latched condition and permitting pivotal movement of said bucket to said unloading position in an unlatched condition; and automatic releasing means on said carriage device operatively connected with said locking means and coacting upon engagement with said first transverse member at said lower position as said carriage moves from said upper position to said lower position to move said locking means from said latched condition to said unlatched condition whereby said bucket is automatically released from said loading position to said unloading position to dispose of debris contained therein onto said chute and into the container.

6. The automatic debris removal device as recited in claim 5 including means for longitudinally adjusting said first transverse member relative to said telescoping members.

7. The automatic debris removal device as recited in claim 6 including a second transverse member attached to said telescoping members and a support member extending between said second transverse member on said chute for supporting said chute relative to said telescoping members.

8. The automatic debris removal device as recited in claim 7 including means for longitudinally adjusting said second transverse member relative to said telescoping members.

9. The automatic debris removal device as recited in claim 5 wherein said automatic releasing means includes a downwardly projecting member that initially engages said first transverse member to move said locking means.

* * * * *